US007971930B2

(12) United States Patent
Larsen et al.

(10) Patent No.: US 7,971,930 B2
(45) Date of Patent: Jul. 5, 2011

(54) TABLE AND BENCH SYSTEM

(75) Inventors: Jered Larsen, Bountiful, UT (US); S. Curtis Nye, Clinton, UT (US); L. Curtis Strong, Clearfield, UT (US); Robert A. Astle, Farmington, UT (US)

(73) Assignee: Lifetime Products, Inc., Clearfield, UT (US)

( * ) Notice: Subject to any disclaimer, the term of this patent is extended or adjusted under 35 U.S.C. 154(b) by 0 days.

(21) Appl. No.: 11/409,301

(22) Filed: Apr. 21, 2006

(65) Prior Publication Data

US 2006/0238003 A1 Oct. 26, 2006

Related U.S. Application Data

(60) Provisional application No. 60/674,158, filed on Apr. 21, 2005.

(51) Int. Cl.
*A47B 83/02* (2006.01)
*A47B 39/00* (2006.01)

(52) U.S. Cl. ..... 297/158.3; 297/142; 297/171; 297/172

(58) Field of Classification Search ..... 297/158.3, 297/158.4, 142, 157.1, 159.1, 141, 171, 172
See application file for complete search history.

(56) References Cited

U.S. PATENT DOCUMENTS 1,156,538 A * 10/1915 Markowicz ..... 297/142
1,165,018 A * 12/1915 Palcso ..... 297/142
1,384,695 A * 7/1921 Gilarski ..... 297/142
1,860,291 A * 5/1932 Majcher ..... 297/141
1,898,307 A * 2/1933 Miller ..... 108/79
1,956,483 A * 4/1934 Alpers ..... 297/141
2,024,045 A * 12/1935 Johnson ..... 297/142
2,110,068 A * 3/1938 Kowalski ..... 108/79
2,279,122 A 4/1942 Kovalchuk
2,306,812 A * 12/1942 Ketive ..... 297/142
2,461,683 A * 2/1949 Dierickx ..... 297/142
2,522,642 A 9/1950 Schmidt
2,524,198 A 10/1950 LaRue
2,657,964 A * 11/1953 Watrous ..... 108/157.17
2,782,837 A * 2/1957 Munsch ..... 297/142
2,991,829 A 7/1961 Post
3,096,866 A * 7/1963 Glass ..... 297/158.4
(Continued)

OTHER PUBLICATIONS

U.S. Appl. No. 29/260,642, filed May 30, 2006, Staples et al.

*Primary Examiner* — David Dunn
*Assistant Examiner* — Tania Abraham
(74) *Attorney, Agent, or Firm* — Maschoff Gilmore & Israelsen, PLLC

(57) ABSTRACT

A picnic table may include a table and one or more seat members disposed about the table. One end of each seat member is preferably pivotally attached to the table by a support structure so that the seat member may pivot or rotate between various positions relative to the table top. One or more feet may be connected to the support structures and the feet may be sized and configured to facilitate movement of the seat members relative to the table top. The picnic table may also include a frame and the frame may include a plurality of elongated support members with a first end and a second end. The elongated support members may be interconnected to form a generally polygon-shaped structure and an end of each support member may extend beyond the perimeter of the generally polygon-shaped structure.

18 Claims, 14 Drawing Sheets

U.S. PATENT DOCUMENTS 3,116,088 A * 12/1963 Thaxton ..... 297/157.1
3,266,840 A * 8/1966 D Estrube ..... 297/158.3
3,414,301 A 12/1968 Crowe
3,486,790 A * 12/1969 Barecki et al. ..... 297/142
3,758,152 A * 9/1973 Lake ..... 297/158.3
3,778,102 A * 12/1973 Snyder et al. ..... 297/170
3,885,829 A 5/1975 Haeger
3,951,449 A * 4/1976 Crowther ..... 297/142
4,126,289 A * 11/1978 Uhlig ..... 248/188.1
4,569,555 A * 2/1986 Lehman ..... 297/141
4,653,804 A 3/1987 Yoo et al.
4,826,244 A 5/1989 Choi
4,883,314 A 11/1989 Sakong
5,029,938 A * 7/1991 Song ..... 297/158.4
D348,989 S 7/1994 Pomeroy et al.
5,333,928 A * 8/1994 Rollinson ..... 297/142
5,352,014 A * 10/1994 Allen ..... 297/142
D354,867 S 1/1995 Lee
5,427,342 A * 6/1995 Gagnon ..... 248/188.9
5,483,904 A * 1/1996 Kelly et al. ..... 108/156
5,485,795 A * 1/1996 Williams ..... 108/69
D368,807 S 4/1996 Noll
5,782,526 A * 7/1998 Ott ..... 297/157.1
5,921,622 A * 7/1999 Newton ..... 297/157.1
5,921,623 A 7/1999 Nye et al.
D417,965 S 12/1999 Strong et al.
6,010,185 A * 1/2000 Petersen ..... 297/158.3
6,010,186 A * 1/2000 Tsay ..... 297/159.1
6,065,802 A * 5/2000 Bue ..... 297/158.4
D429,903 S 8/2000 Iannaccone
6,102,475 A * 8/2000 Hamann ..... 297/172
6,109,687 A 8/2000 Nye et al.
D431,918 S 10/2000 Tseng
D442,788 S 5/2001 Nye et al.
6,347,831 B1 2/2002 Nye et al.
6,443,521 B1 9/2002 Nye et al.
D463,919 S 10/2002 Lee
6,761,340 B2 * 7/2004 Shaw ..... 248/188.9
6,817,662 B2 11/2004 Winter et al.
6,832,563 B2 12/2004 Stanford
6,848,370 B1 2/2005 Stanford
6,848,741 B2 * 2/2005 Ford et al. ..... 297/157.1
6,895,872 B2 5/2005 Stanford
6,899,385 B2 * 5/2005 Pernicka et al. ..... 297/142
D506,631 S 6/2005 Astle
6,905,166 B2 6/2005 Zhurong et al.
6,945,178 B1 9/2005 Nye et al.
D511,417 S 11/2005 Astle et al.
7,048,332 B1 * 5/2006 Dilling ..... 297/172
7,055,899 B2 6/2006 Zhurong et al.
2006/0027148 A1 * 2/2006 Chen ..... 108/50.12
2006/0181114 A1 8/2006 Nye et al.
2006/0238003 A1 10/2006 Larsen et al.
2007/0157857 A1 * 7/2007 Bottemiller ..... 108/103

* cited by examiner

TABLE AND BENCH SYSTEM

CROSS-REFERENCE TO RELATED APPLICATIONS

This application claims priority to and the benefit of U.S. provisional patent application Ser. No. 60/674,158, filed Apr. 21, 2005 and entitled TABLE AND BENCH SYSTEM, the disclosure of which is incorporated by reference.

BACKGROUND OF THE INVENTION

1. Field of the Invention

The present invention generally relates to furniture and, in particular, to tables and benches.

2. Description of Related Art

Picnic tables have been used for many years and conventional picnic tables typically include a center table with benches disposed on both sides of the table. Conventional picnic tables may have a rectangular configuration and may be sized to allow four, six or eight persons to sit at one time. Picnic tables are usually located outdoors and are often used as part of an outdoor social gathering that generally includes food or a meal.

It is known to use various types of wood to construct a picnic table. For example, the table top, bench tops and support legs may be constructed from wood. Wooden picnic tables, however, often quickly deteriorate because the picnic tables may be exposed to the elements such as sun and rain. Accordingly, wooden picnic tables must be frequently painted or stained in order to protect the wood from damage. It is also known to use metal legs to support picnic tables with table tops and bench tops constructed from wood. The metal legs must be relatively large and strong to support the heavy wooden table top and bench tops.

Disadvantageously, conventional picnic tables constructed from wood are very heavy and require a bulky, heavy-duty frame to support the table top and bench tops. These heavy, wooden picnic tables are often very difficult to transport and move. In addition, known picnic tables with metal legs often require a large and complex frame to support the table top and bench tops. In particular, many known picnic tables require the metal legs to be constructed from large diameter tubing and/or large wall thickness tubing to provide the necessary strength for the legs. Legs constructed from large diameter tubing and/or large wall thickness tubing, however, often undesirably increases the weight and cost of the picnic table. The metal legs also often require one or more brackets or support struts to adequately support the table top and bench tops. These brackets and support struts are often placed underneath the table top, which decreases the amount of space and legroom under the table top. Additionally, the brackets or struts undesirably add to the weight and complexity of the picnic table.

Known picnic tables often include a number of support struts or braces to securely connect the frame to the table top and the benches. These support struts and braces, however, often interfere with a desired sitting position for an individual seated at the picnic table, and the struts and braces decrease the leg room under the table. That is, the supports and braces often contact an individual's knees or legs, and that decreases the comfort and usefulness of the picnic table. The struts and braces may also limit the number of people that can sit at the picnic table. In particular, because many struts and braces are positioned at various angles relative to the table top and benches, the legroom under the table top is decreased and the risk that a person will strike their knees on the struts or braces is increased.

BRIEF SUMMARY OF EMBODIMENTS OF THE INVENTION

A need therefore exists for a table and bench system that eliminates or reduces the above-described disadvantages and problems.

One aspect is table and bench system that may be configured as a picnic table. The picnic table may include a table and one or more seat members disposed about the table. The seat members may be a bench, a chair or other type of suitable structure. The seat members may also include a backrest, armrests and the like.

Another aspect is a picnic table that may include a frame that supports the table and the seat members. The frame preferably includes one or more table legs or supports that support the table top, and one or more seat legs or supports that support the seat members. The table supports may be integrally formed with or otherwise connected to the seat supports, which may help create a stable frame.

A further aspect is a picnic table that may include one or more support structures and the support structures may include a table support and a seat support. Preferably, the support structures are pivotally, rotatably or otherwise movably attached to the seat members. Advantageously, this may allow the seat members to pivot, rotate or move into a desired position. If desired, the support structures may be pivotally, rotatably or otherwise movably attached to the table top, which may also allow the seat member to pivot, rotate or otherwise move into a desired position. If the support structures are movably attached both to the table top and the seat member, then the seat member may be capable of being moved among a number of different positions.

Because the seat members may pivot, rotate or otherwise move between different positions, the seat members may be more convenient to use regardless of a person's age, size or physical dexterity. The seat members may also allow users to face in different desired directions. In addition, the seat members may be sized and configured to move between extended or use positions and retracted or storage positions. This may allow the picnic table to be stored and/or shipped in a more compact configuration. For example, in the storage position, all or at least a portion of the seat members may be positioned underneath the table top to reduce the size and bulk of the system.

Still another aspect is a picnic table that may include a frame and the frame may include a plurality of table supports. The table supports are preferably interconnected by a reinforcing assembly. The reinforcing assembly and/or the table top may include one or more apertures that may be sized and configured to receive at least a portion of an umbrella, an awning or the like.

Yet another aspect is a picnic table that may include a table top, a frame and a foot. The foot may include a receiving portion that is sized and configured to receive a portion of the frame. The foot may also include a drain that allows liquid to exit the receiving portion of the foot. In addition, the foot may include a cradle that is sized and configured to contact, abut and/or engage the frame.

Another aspect is a picnic table that may include a table top and a frame connected to the table top. The frame may include a plurality of elongated supports that form a polygon-shaped structure. The polygon-shaped structure may have a generally regular configuration in which each side of the polygon has generally the same length, but the structure could have any suitable size, shape and configuration. A portion of the elongated supports may extend beyond the perimeter of the polygon-shaped structure, if desired, which may allow the edges of the table top to be securely supported.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further illustrate and clarify the above and other aspects, advantages and features of the present invention. It will be appreciated that these drawings depict only preferred embodiments of the invention and are not intended to limit its scope. The invention will be described and explained with additional specificity and detail through the use of the accompanying drawings in which.

DETAILED DESCRIPTION OF THE PREFERRED EMBODIMENTS

Figure 1:
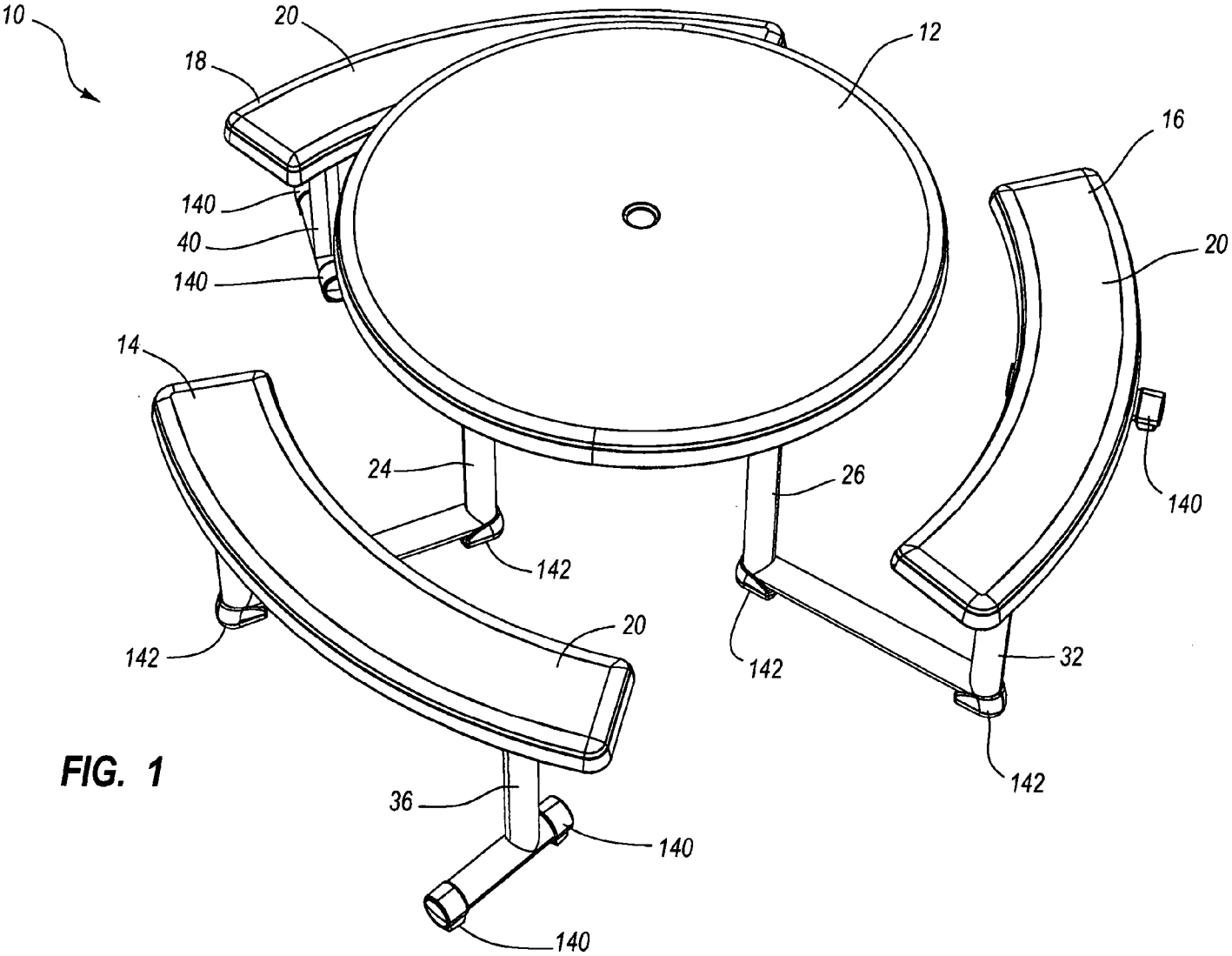
FIG. 1 is a perspective view of an exemplary table and bench system, illustrating the table and bench system configured as a picnic table.

The present invention is generally directed towards tables and benches. The principles of the present invention, however, are not limited to tables and benches. It will be understood that, in light of the present disclosure, the tables and benches disclosed herein can have a variety of different shapes, sizes, arrangements and configurations, and the various features and aspects disclosed herein be successfully used in connection with other types of furniture and structures.

Additionally, to assist in the description of the table and bench system, words such as top, bottom, front, rear, right and left may be used to describe the accompanying figures, which are not necessarily drawn to scale. It will be appreciated, however, that the table and bench system can be located in a variety of desired positions.

As shown in the accompanying figures and discussed in more detail below, an exemplary embodiment of the table and bench system is a picnic table. The table and bench system, however, could have a variety of other appropriate designs, compositions and the like. Thus, while the table and bench system is illustrated as being a picnic table, it will be understood that the table and bench system is not limited to a picnic table. A detailed description of the table and bench system now follows.

As shown in FIGS. 1-7, a exemplary picnic table 10 may include a table top 12 and one or more seat members 14, 16, 18. The seat members 14, 16, 18 may be seats, benches, chairs or other suitable types of structures. The seat members 14, 16, 18 may also include backrests, armrests and the like.

The seat members 14, 16, 18 are preferably seats 20 that have an elongated configuration. The seats 20 are also preferably curved with an inner radius of curvature and an outer radius of curvature, which may be the same or different. In addition, the seats 20 may have a radius of curvature and the table top 12 may have a radius of curvature. The radius of curvature of the seats 20 may be the same or different as the radius of the table top 12. If the radius of curvature of the seats 20 and the table top 12 are different or not concentric, then that may help provide additional stability to the picnic table 10. It will be appreciated that the seats 20 and/or table top 12 may have other suitable configurations and arrangements depending, for example, upon the intended use of the picnic table 10.

The picnic table 10 may include a frame 22 that supports the table top 12 and the seat members 14, 16, 18. The frame 22 preferably includes table legs or supports 24, 26, 28 that support the table top 12; and seat legs or supports 30, 32, 34, 36, 38, 40 the support the seat members 14, 16, 18, respectively. It will be appreciated that the frame 22 could have other suitable shapes, sizes, configurations and arrangements depending, for example, if table top 12 is round, oval, hexagonal, octagonal, polygonal, irregular, etc.; the number of that seat members 14, 16, 18; the size and shape of the seat members; and the like.

The table supports 24, 26, 28 preferably are integrally formed with or otherwise connected to the seat support 30, 32, 34, respectively, which may help create a stable frame 12. Advantageously, with the table supports 24, 26, 28 connected to the seat supports 30, 32, 34, the seat members 14, 16, 18 may be generally connected to the rest of the picnic table 12, which may help in positioning the seats and preventing theft or inadvertent loss of the seats. The table supports 24, 26, 28 and seat supports 30, 32, 34, however, do not have to be connected.

In greater detail, the frame 22 may include support structures 42, 44, 46, which may connect or include the table supports 24, 26, 28 and seat supports 30, 32, 34, respectively. In particular, the support structures 42, 44, 46 may include intermediate supports 48, 50, 52 that connect the table supports 24, 26, 28 and the seat supports 30, 32, 34.

The support structures 42, 44, 46 are preferably pivotally, rotatably or otherwise movably attached to the seat members 14, 16, 18 to allow the seat member to pivot, rotate or otherwise move between a variety of positions. In particular, the seat supports 30, 32, 34 are preferably pivotally, rotatably or otherwise movably attached to the seat members 14, 16, 18. If desired, the support structures 42, 44, 46 may also be pivotally, rotatably or otherwise movably attached to the table top 12. If the support structures 42, 44, 46 are movably attached both to the table top 12 and to the seat members 14, 16, 18, then the seat members may be capable of being moved among a variety of different positions relative to the table top, providing numerous seating arrangements.

Figure 2:
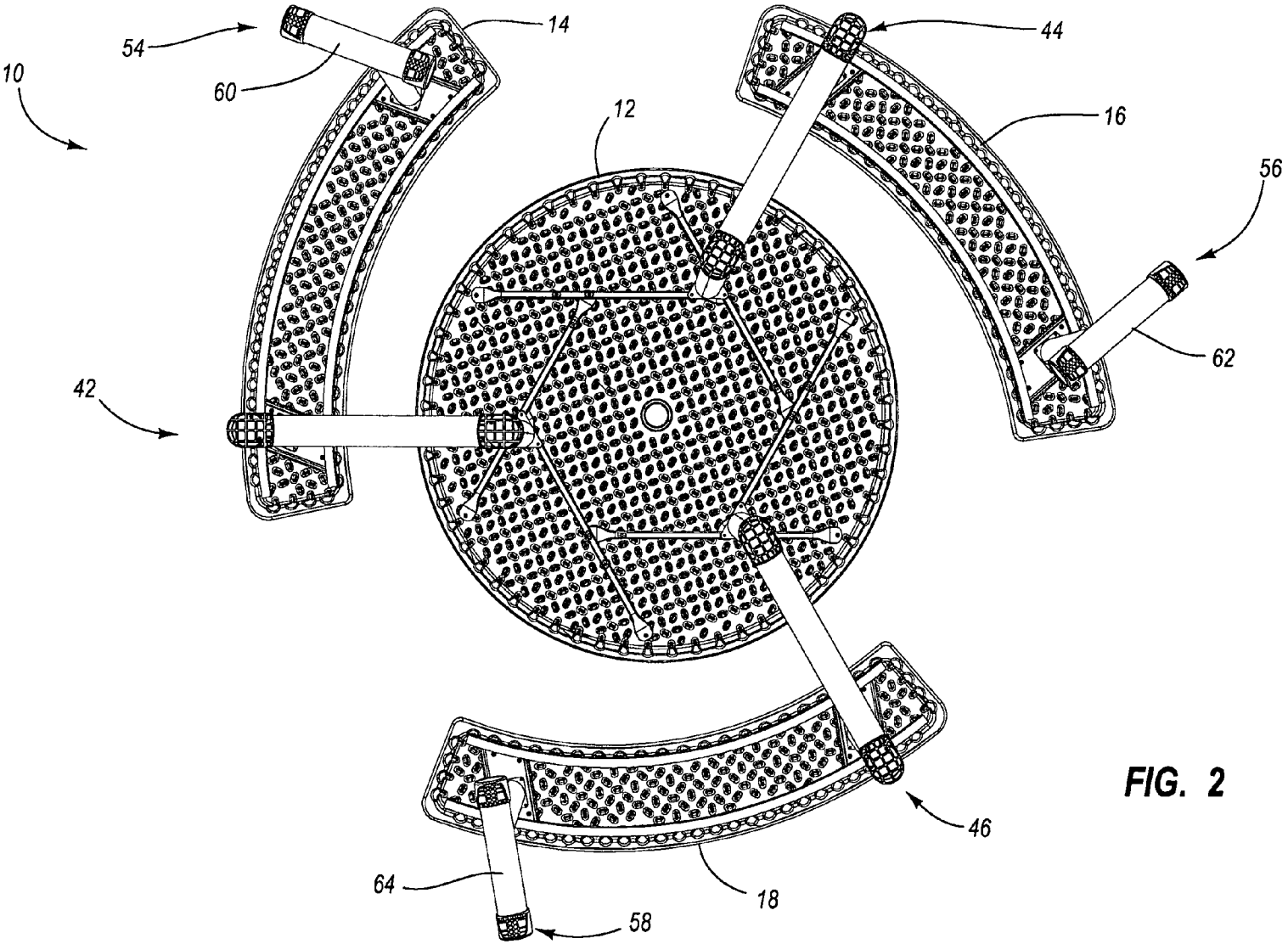
FIG. 2 is a bottom view of the picnic table shown in FIG. 1.
Figure 3:
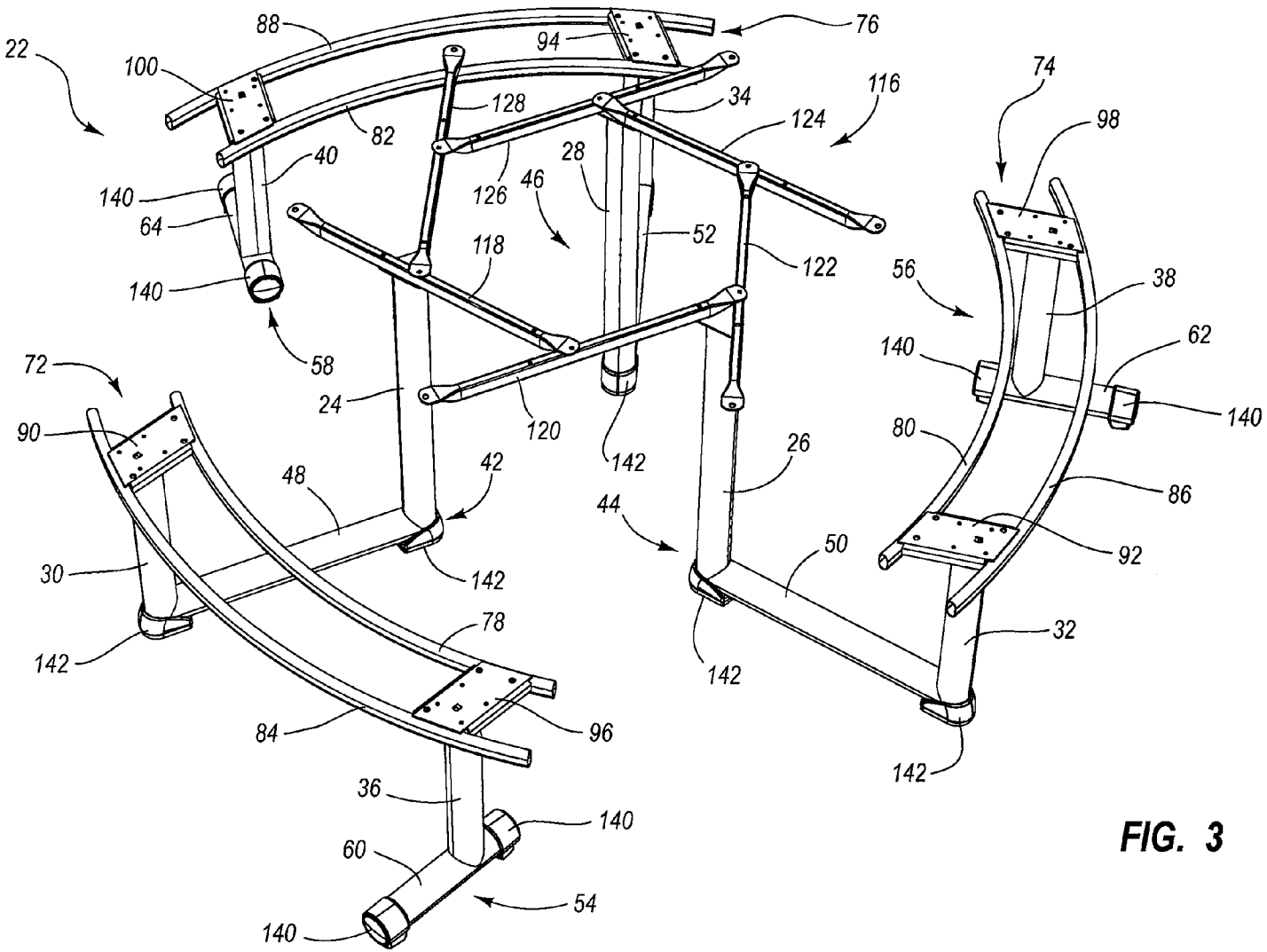
FIG. 3 is a perspective view of a portion of the picnic table shown in FIG. 1.

In greater detail, the frame 22 may include support structures 42, 44, 46, which may connect or include the table supports 24, 26, 28 and seat supports 30, 32, 34, respectively. In particular, the support structures 42, 44, 46 may include intermediate supports 48, 50, 52 that connect the table supports 24, 26, 28 and the seat supports 30, 32, 34. As shown in FIGS. 1-3, the intermediate supports 48, 50, 52 may have a length generally equal to or greater than a length of the seat legs or supports 30, 32, 34, 36, 38, 40 that support the seat members 14, 16, 18, respectively.

Figure 6:
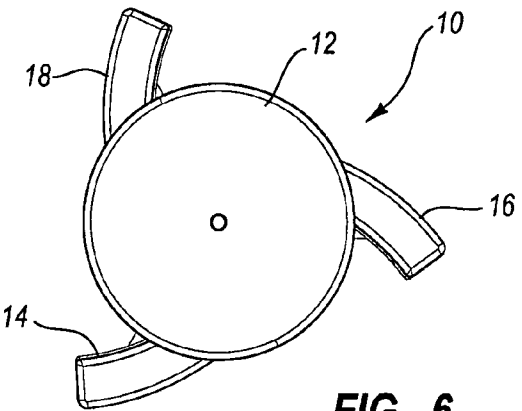
FIG. 6 is a top view of the picnic table shown in FIG. 1, illustrating yet another exemplary position of the seat members.
Figure 4:
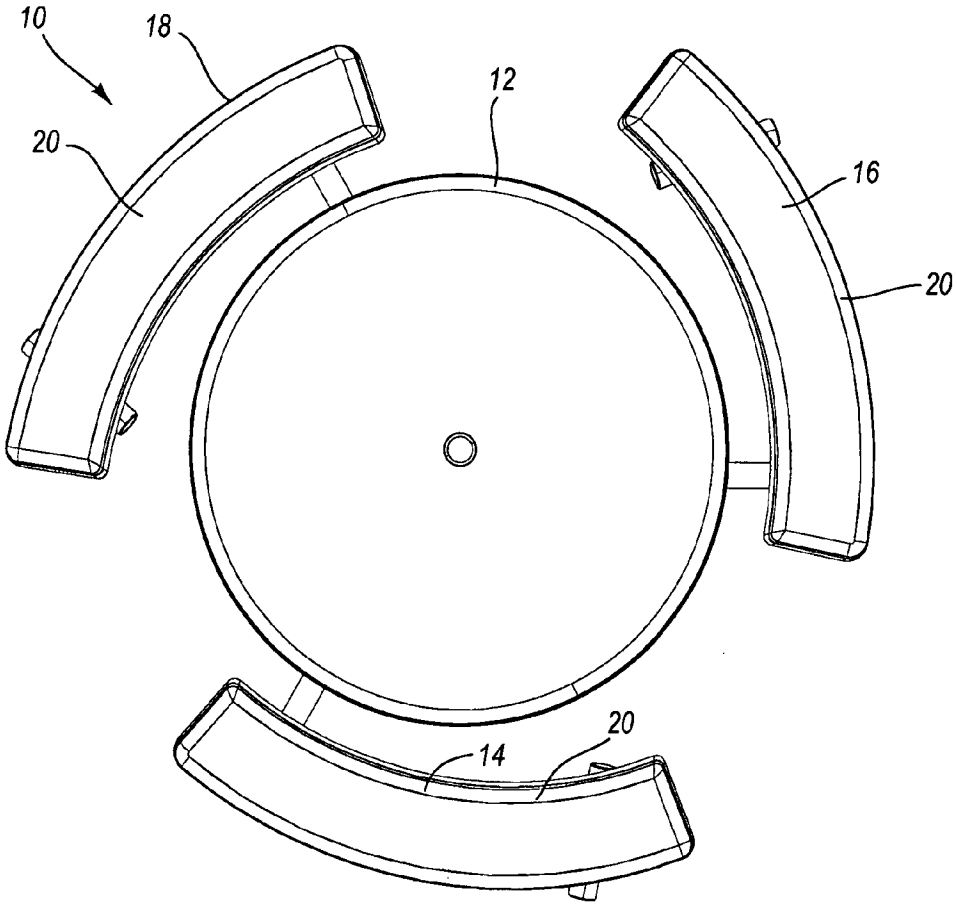
FIG. 4 is a top view of the picnic table shown in FIG. 1, illustrating an exemplary position of the seat members.
Figure 7:
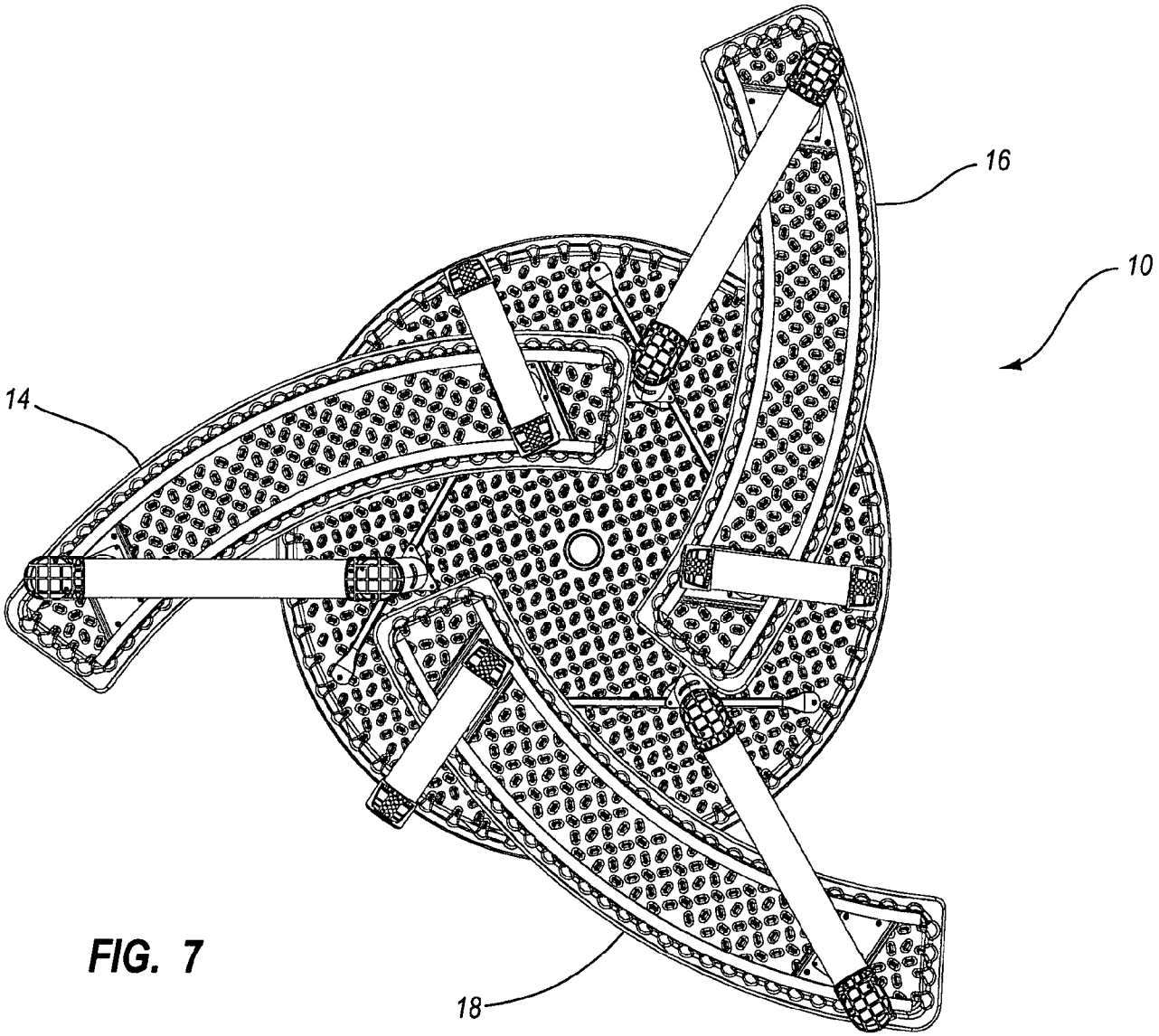
FIG. 7 is a bottom view of the picnic table shown in FIG. 1, illustrating the exemplary position of the seat members shown in FIG. 6.

If desired, when the seat members 14, 16, 18 are in the storage position as shown in FIGS. 6 and 7, the seat members may engage the table supports 26, 28, 24, respectively, using a snap, friction or interference fit to help retain the seat members in the storage position. In particular, as the seat members 14, 16, 18 are moved into the storage position, the table supports 24, 26, 28 and/or the seats 20 may deform or deflect to allow the table supports and the seats to engage each other with a snap, friction or interference fit. As the seat members 14, 16, 18 are moved away from the storage position, the table supports 24, 26, 28 and/or the seats 20 may deform or deflect to allow the table supports and the seats to disengage from the snap, friction or interference fit. The seat members 14, 16, 18 could also be secured in the storage position using other suitable structures and devices, if desired.

As shown in FIGS. 1-7, the frame 22 preferably includes support structures 54, 56, 58, which may include seat supports 36, 38, 40, respectively. The support structures 54, 56, 58 may also include lower supports 60, 62, 64 that are connected to the seat supports 36, 38, 40. The support structures 54, 56, 58 are preferably connected to the seat members 14, 16, 18 in a fixed position, but the support structures may also be pivotally, rotatably or otherwise movably attached to the seat members, if desired.

The support structures 42, 44, 46, 54, 56, 58 may include an end that is sized and configured to be attached to another structure. For example, the ends of the support structures 42, 44, 46, 54, 56 and/or 58 may include a receiving portion that is sized and configured to receive a portion of another support. The receiving portions may have edges that are generally complementary to an outer surface of the other support, which may allow the supports to be snugly connected.

Figure 9:
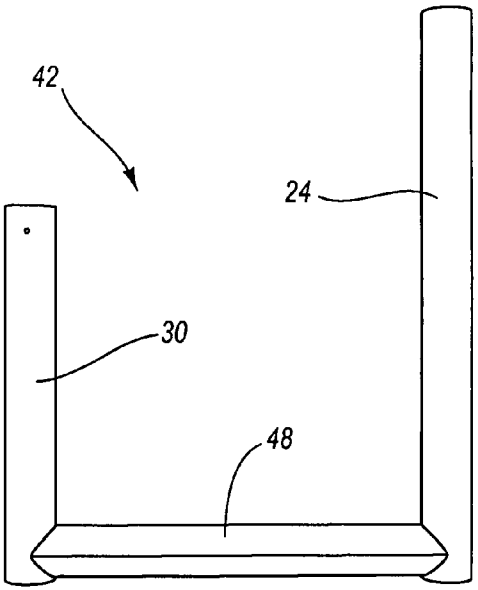
FIG. 9 is a side view of the support structure shown in FIG. 8.
Figure 11:
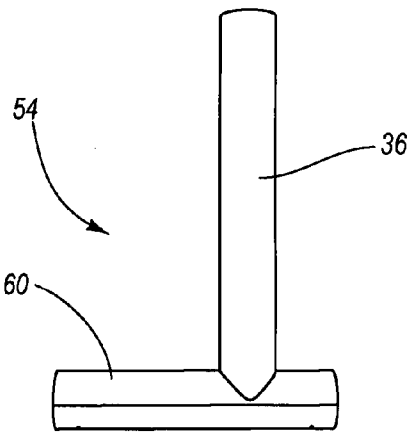
FIG. 11 is a side view of the support structure shown in FIG. 10.
Figure 8:
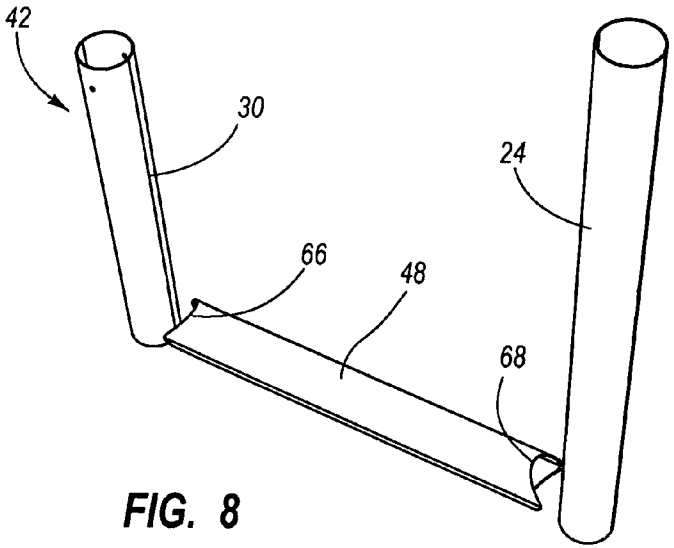
FIG. 8 is an exploded view of an exemplary support structure that may be used in connection with the picnic table.
Figure 10:
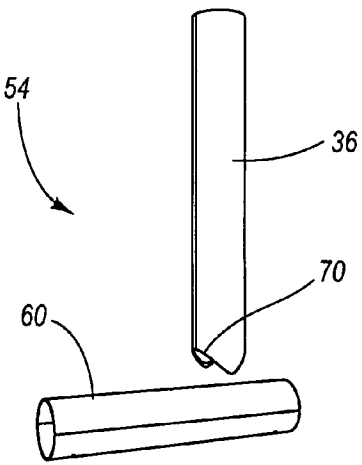
FIG. 10 is an exploded view of another exemplary support structure that may be used in connection with the picnic table.

In further detail, as shown in FIGS. 8 and 9, the intermediate support 48 of the support structure 42 may include a first coped end 66 that may be connected to the seat support 30 and a second coped end 68 that may be connected to the table support 24. As shown in FIGS. 10 and 11, the seat support 36 of the support structure 54 may include a coped end 70 that may be connected to the lower support 60. It will be appreciated, however, that the support structures 42, 44, 46, 54, 56, 58 do not require coped ends and the support structures could be connected using other suitable configurations and arrangements. Further, these components may be unitary, one-piece structures and these structures may be connected at any desired angles.

As shown in FIG. 3, the frame 22 may also include seat frames 72, 74, 76. The seat frames 72, 74, 76 preferably include an inner rail 78, 80, 82; an outer rail 84, 86, 88; a first bracket 90, 92, 94; and a second bracket 96, 98, 100. The first and second brackets 90, 92, 94, 96, 98, 100 are preferably connected to the inner and outer rails 72, 74, 76, 78, 80, 82 of the seat frame.

Figure 12:
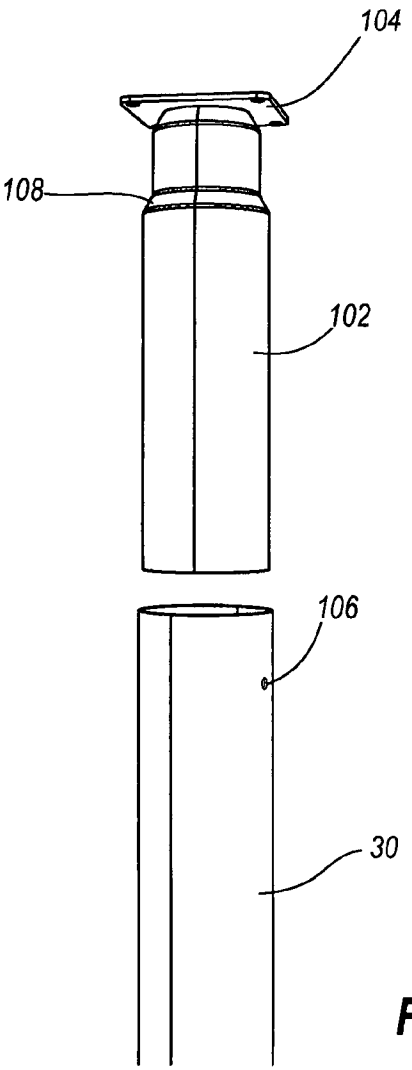
FIG. 12 is an exploded view of an exemplary portion of the frame.

As mentioned above, the support structures 42, 44, 46 preferably are pivotally, rotatably or otherwise movably attached to the seat members 14, 16, 18. In further detail, as shown in FIG. 12, a support 102 may be connected to a plate 104 and the plate 104 may be connected to a portion of the seat frame 72, such as the bracket 90. The support 102 may be sized and configured to be inserted into the seat support 30 of the support structure 42 to pivotally, rotatably or otherwise movably couple the supports 30, 102.

To help prevent the separation of the support 30 and the support 102, the support 30 may include an opening 106 that is sized and configured to receive a fastener such as a bolt or a screw. The fastener is preferably positioned to allow the support 102 to rotate relative to the support 30. In addition, the fastener is preferably positioned such that an end of the fasteners may contact a portion of the support 102 (such as a tapered portion 108) when the separation of the support 30 and the support 102 is attempted.

If desired, multiple supports 102 and plates 104 may be used to pivotally, rotatably or otherwise movably attach the support structures 42, 44, 46 to the seat members 14, 16, 18 and/or the table top 12. It will be appreciated, however, that the support structures 42, 44, 46 and other portions of the picnic table 10 may be connected using other suitable structures.

Figure 13:
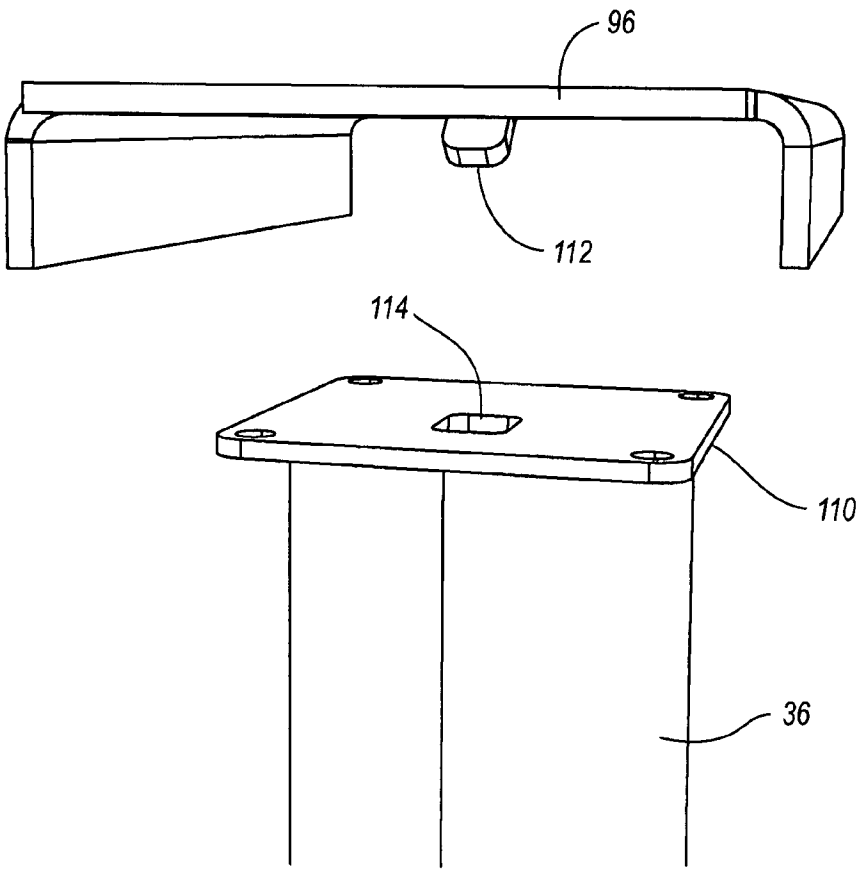
FIG. 13 is an exploded view of another exemplary portion of the frame.

As mentioned above, the seat frames 72, 74, 76 may include brackets 90, 92, 94, 96, 98, 100. The brackets may be connected to other portions of the frame 22. For example, a support of the frame 22 may be connected to a plate and the plate may be connected to a bracket of a seat frame. The plate and the bracket may include one or more positioning members that are sized and configured to position the brackets and the plate in a desired position, which may facilitate faster and/or more accurate assembly. In greater detail, as shown in FIG. 13, the seat support 36 may be connected to a plate 110 and the plate may be connected to the bracket 96. The bracket 96 and the plate 110 may each include one or more positioning members, such as a tab 112 and an opening 114 that is sized and configured to receive at least a portion of the tab 112. The tab 112 and the opening 114 are preferably sized and configured to contact, abut and/or engage each other to help guide and align the bracket 96 and the plate 110 in the desired position. This may help the bracket 96 and the plate 110 be quickly and easily positioned in the desired locations, which may facilitate faster assembly of the picnic table 10. If desired, the bracket 96 may include one or more tabs corresponding to one or more openings of the plate 110, and the plate may include one or more tabs corresponding to one or more openings of the bracket.

As shown in FIG. 3, the frame 22 may also include a table frame 116 and the table frame may include supports 118, 120, 122, 124, 126, 128. The table frame supports 118 120, 122, 124, 126, 128 preferably have an elongated shape with a first end and a second end. The table frame supports 118, 120, 122, 124, 126, 128 are preferably interconnected and also connected to the support structures 42, 44, 46. For example, the first end of the support 118 is preferably connected to the support 120 and the second end of the support 118 preferably extends beyond an intermediate portion of the support 118 to which the support 128 and the support structure 42 may be connected. The table frame supports 118, 120, 122, 124, 126, 128 may form a generally regular polygon-shaped structure and the ends of the supports may extend beyond the perimeter of the polygon-shaped structure. This arrangement may help diffuse forces and/or weight applied to the table frame 116. This arrangement may also help support the perimeter of the table top 12. It will be appreciated that the table frame supports 118, 120, 122, 124, 126, 128 may have a variety of suitable shapes, sizes, arrangements and configurations depending, for example, upon the intended us of the picnic table 10.

Figure 14:
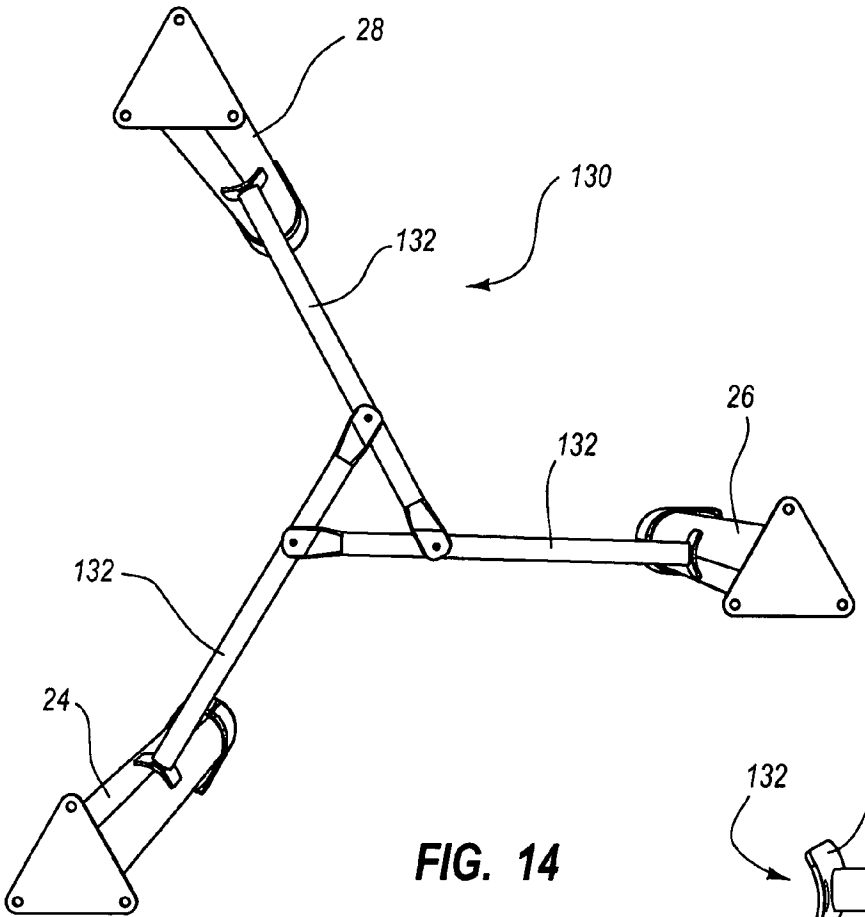
FIG. 14 is a top view of a portion of the table shown in FIG. 1, illustrating a portion of the reinforcement assembly.

The frame 22 may also include a reinforcement assembly 130 that is connected to the supports 24, 26, 28, which may help strengthen and reinforce the frame. For example, as shown in FIG. 14, the reinforcement assembly 130 may include a plurality of interconnected supports 132. The supports 132 are preferably connected to a generally central portion of the supports 24, 26, 28, but the supports 132 may be connected to other suitable portions of the supports 24, 26, 28. The supports 132 and/or the table top 12 may include one or more apertures sized and configured to receive at least a portion of an umbrella, an awning or the like to help secure the umbrella or awning in a desired position. The umbrella or awning may then provide shade, cover or other protection from the weather.

Figure 15:
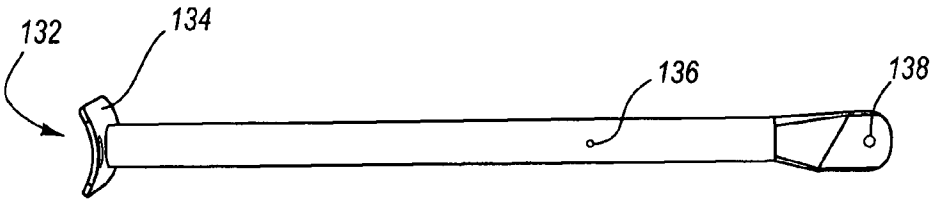
FIG. 15 is side view of a portion of the reinforcement assembly shown in FIG. 14.

In greater detail, as shown in FIGS. 14 and 15, each of the supports 132 preferably includes a bracket 134 that is sized and configured to be connected to one of the table supports 24, 26, 28; a first portion 136 that is sized and configured to be connected to another support 132; and a second portion 138 that is sized and configured to be connected to yet another support 132. This arrangement may advantageously help reinforce and/or strengthen the frame 22. It will be appreciated, however, that the reinforcement assembly 130 may have other suitable components, arrangements and the like.

Figure 16:
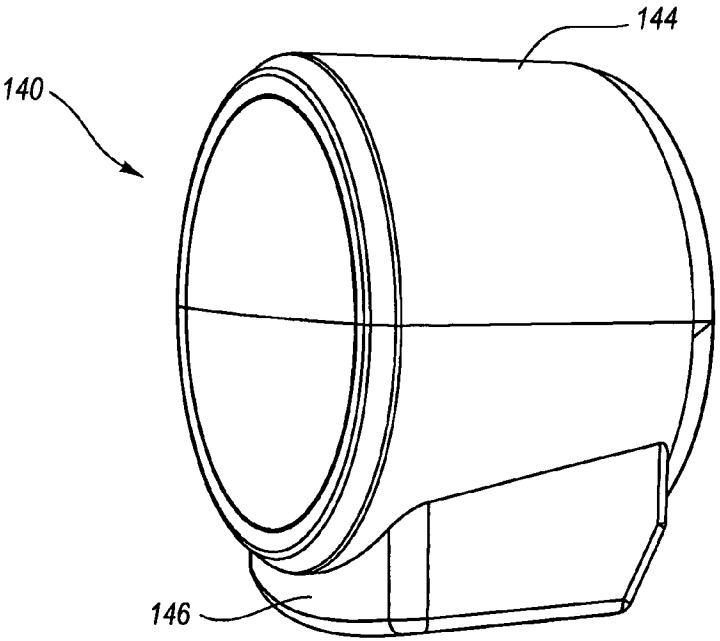
FIG. 16 is a perspective view of a portion of the picnic table shown in FIG. 1, illustrating a foot.

As shown in the accompanying figures, the picnic table 10 may include feet 140, 142 that are sized and configured to contact and/or engage a support surface. The feet 140, 142 may elevate the frame 22 of the picnic table 10 and the feet may facilitate movement of the seat members 14, 16, 18. In greater detail, as shown in FIG. 16, the feet 140 may include a body 144 that is sized and configured to receive a portion of the lower support 60, 62, 64. The feet 140 may also include an extension 146 that is sized and configured to contact and/or engage the support surface. The extension 146 may include a beveled lower surface, which may make it easier to move the seat members 14, 16, 18. It will be appreciated, however, that the extension 146 does not require any beveled surfaces and the feet could have other suitable shapes and sizes depending, for example, upon the intended use of the picnic table 10.

Figure 18:
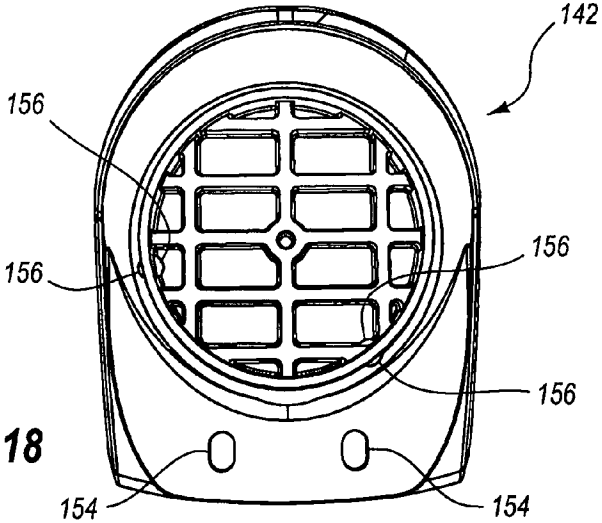
FIG. 18 is a top view of the foot shown in FIG. 17.
Figure 19:
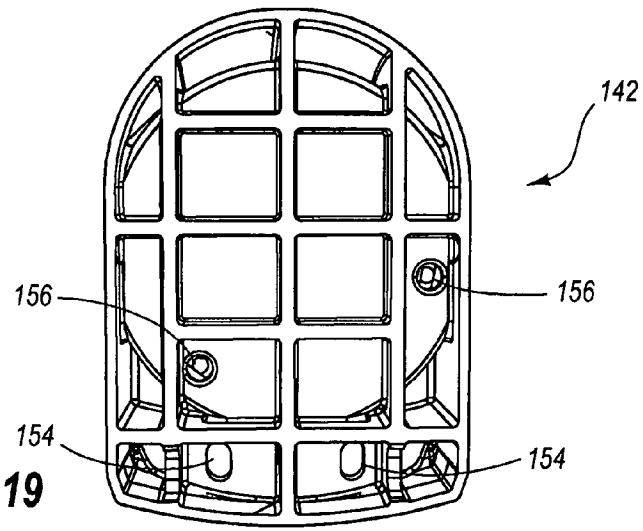
FIG. 19 is a bottom view of the foot shown in FIG. 17.
Figure 17:
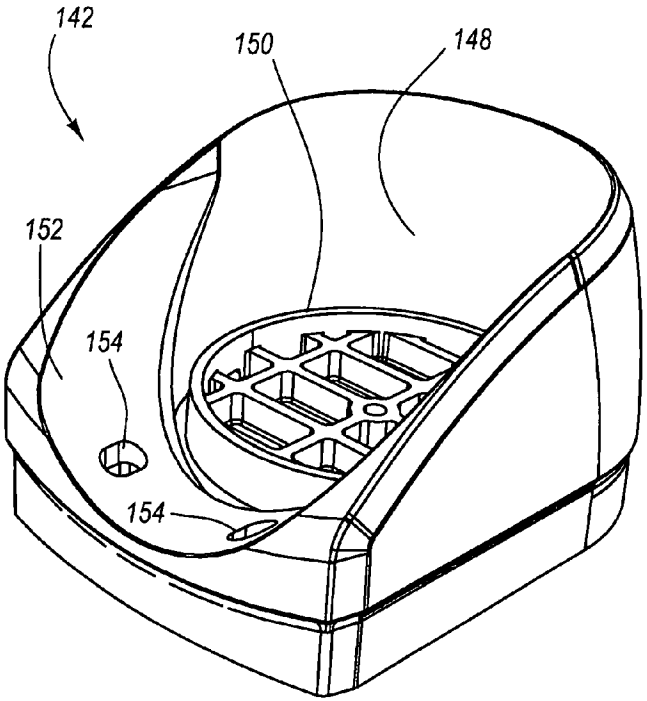
FIG. 17 is a perspective view of a portion of the picnic table shown in FIG. 1, illustrating another foot.

As shown in FIGS. 17-19, the feet 142 may include a receiving portion 148 that is sized and configured to receive a portion of the support structures 42, 44, 46. The surface of the receiving portion 148 is preferably generally complementary to the outer surface of the table or seat support. The feet 142 may also include a reinforcing member 150 that may help reinforce a portion of the table or seat support. In particular, the table or seat support may have a generally tubular configuration and the reinforcing member 150 may be sized and configured to be inserted into an end of the tubular support. The reinforcing member 150 may help reinforce the end of the tubular support, which may help prevent the end of the support from being permanently misshaped or otherwise damaged when, for example, weight is placed upon the table and/or a seat. To help reinforce the tubular support, the projection 150 preferably includes an outer surface that is is generally complementary to the inner surface of the tubular support. The reinforcing member 150 may also include one or more ribs, which may help strengthen the projection and may help aid in manufacturing the feet 142. It will be appreciated that the projection 150, the tubular support, and the inner surface of the tubular support may have other suitable shapes, configurations and the like. If desired, other types of reinforcing members or structures (such as a metal washer) may be connected to a portion of the feet 142 (such as the projection 150), and these other types of reinforcing members may be sized and configured to be inserted into the tubular support and may include an outer surface that is generally complementary to the inner surface of the tubular support.

The feet 142 may further include a cradle 152 that is sized and configured contact, abut and/or engage an intermediate support 48, 50, 52 of the support structures 42, 44, 46. The surface of the cradle 152 is preferably generally complementary to the outer surface of the intermediate support. The cradle 152 may help facilitate attachment of the feet 142 to the support structure.

Additionally, the feet 142 may include openings 154 that are sized and configured to receive fasteners, which may be used to connect the feet to the intermediate supports. As shown in FIG. 19, the openings may be spaced apart from the support surface, which may allow fasteners to be disposed within a hollow portion of the feet 142. This may help protect the fasteners and may provide a more appealing visual appearance. In addition, this may help prevent the fasteners from contacting and damaging a support surface.

As shown in FIGS. 18 and 19, the feet 142 may include drains 156 that are sized and configured to allow liquid, such as water, to exit the feet. For example, as discussed above, the table or seat support may have a tubular configuration and the projection 150 may be inserted into a hollow portion of the support. The drains 156 may be sized and configured to allow water to exit the receiving portion 148. The drains 156 may be especially advantageous when, for example, the picnic table 10 is used outside where the picnic table could be subjected to rain, water from sprinkling systems and the like.

As best seen in FIGS. 2, 3 and 11, the support structures 54, 56, 58 may include a seat support and a lower support connected to the seat support. The seat support is preferably connected to the lower support in a generally offset configuration. For example, the lower support 60 is preferably offset in a direction generally away from the table top 12 when the seat member 14 is generally aligned with the outer perimeter of the table top, which may increase the stability of the seat member. The lower support 60 and/or the foot 140 may extend beyond the outer perimeter of the seat member, which may also increase the stability of the seat member.

Figure 20:
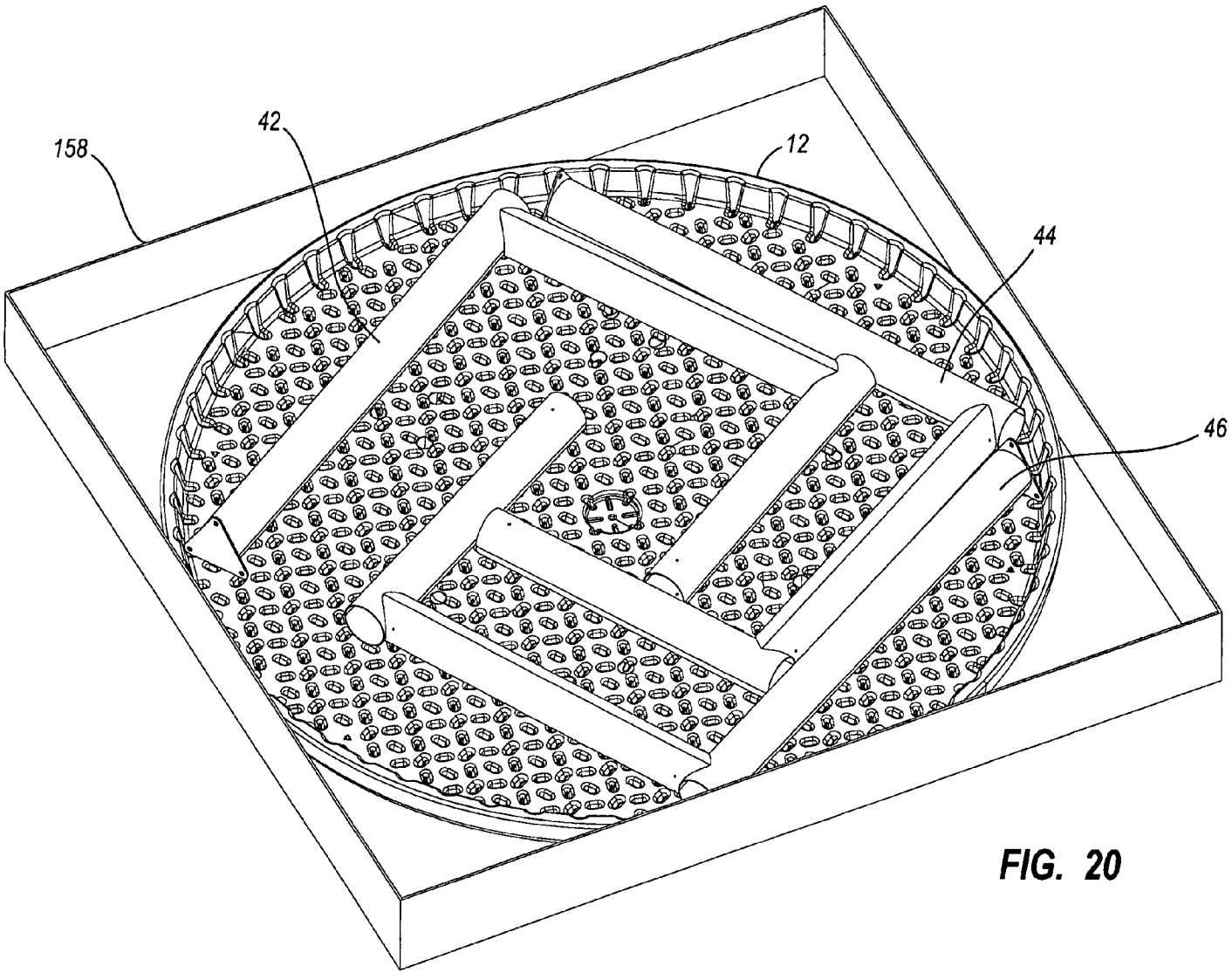
FIG. 20 is a perspective view of an exemplary arrangement for disposing various components of a picnic table within a container.
Figure 21:
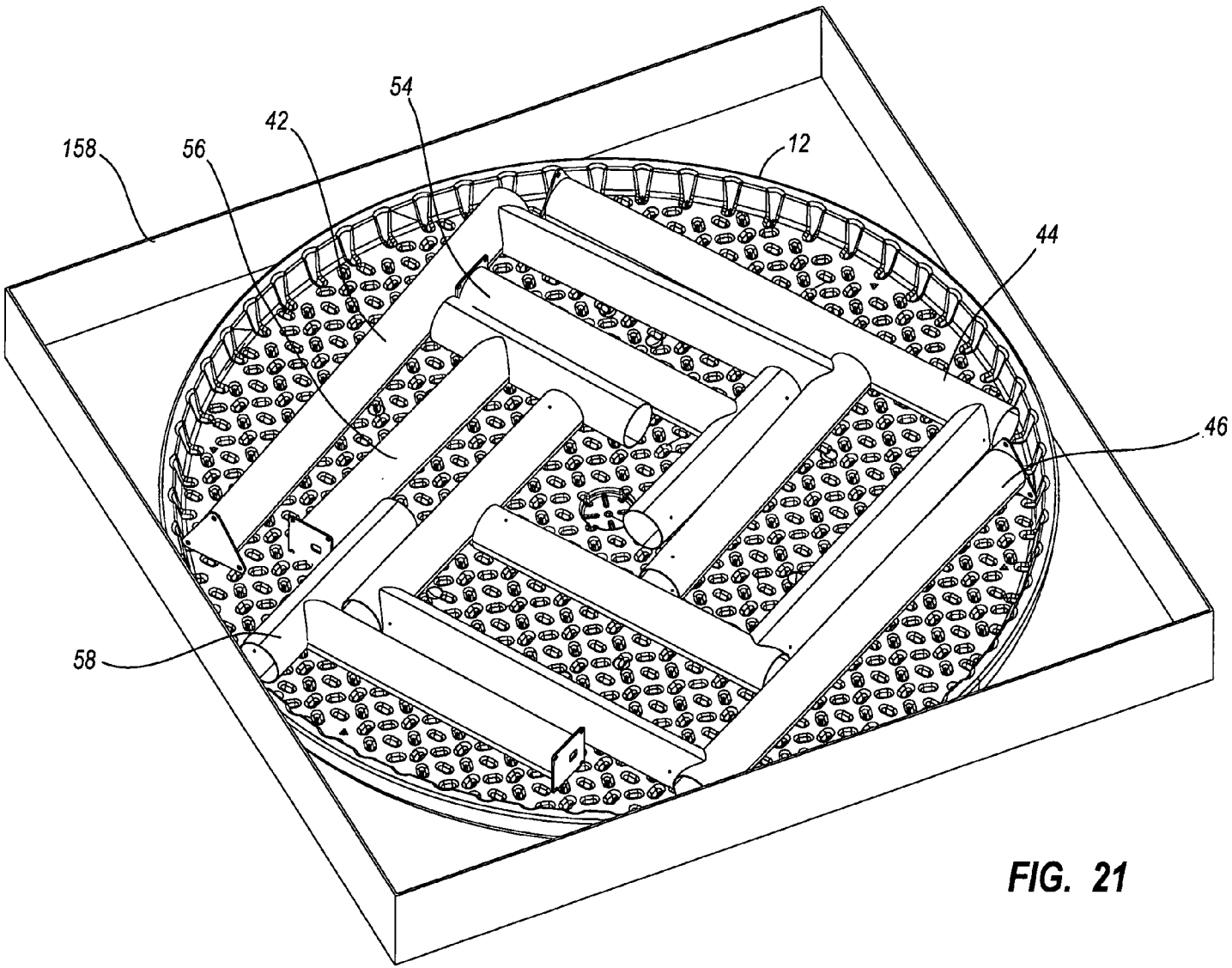
FIG. 21 is another perspective view of an exemplary arrangement for disposing various components of a picnic table within a container.
Figure 22:
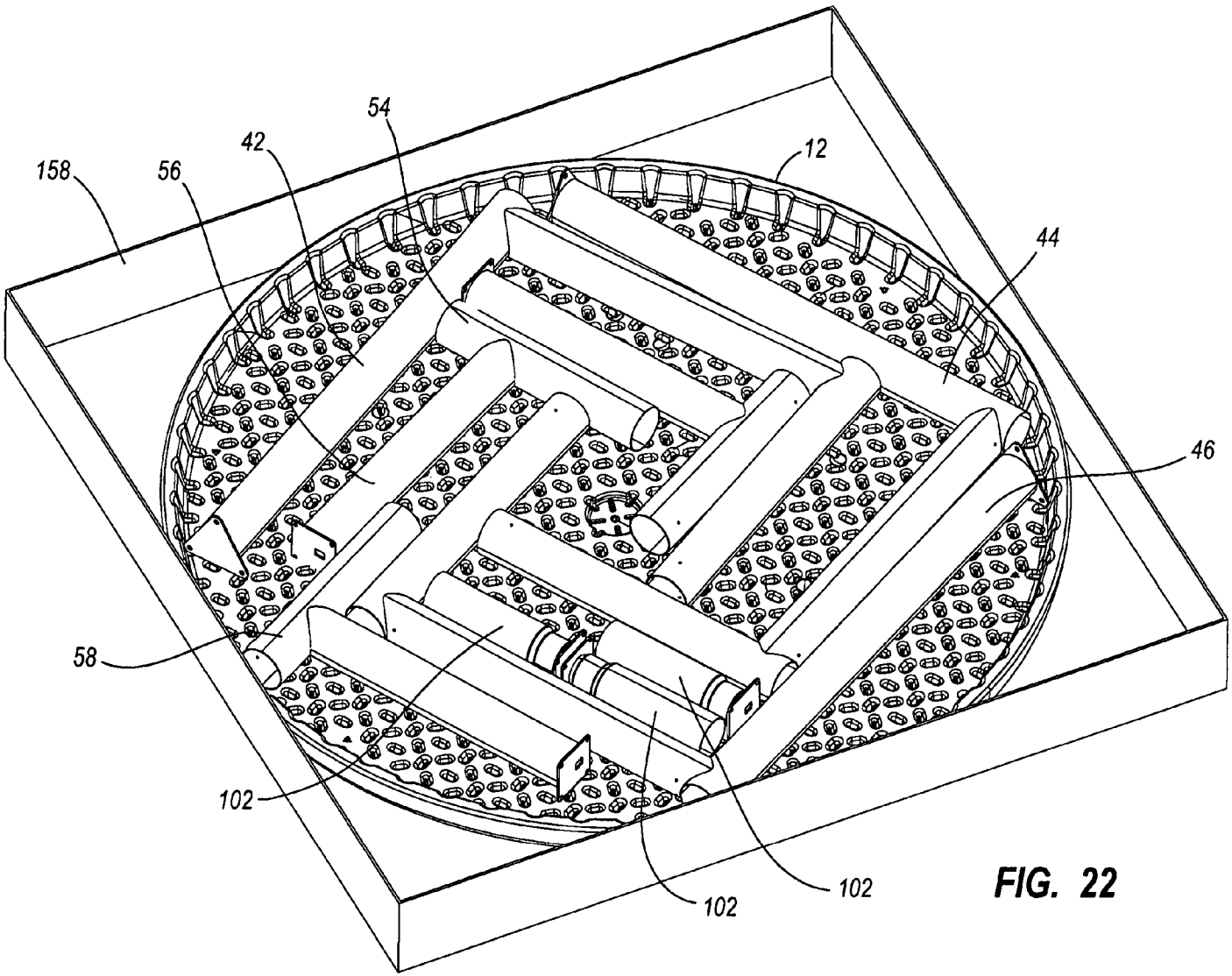
FIG. 22 is still another perspective view of an exemplary arrangement for disposing various components of a picnic table within a container.
Figure 23:
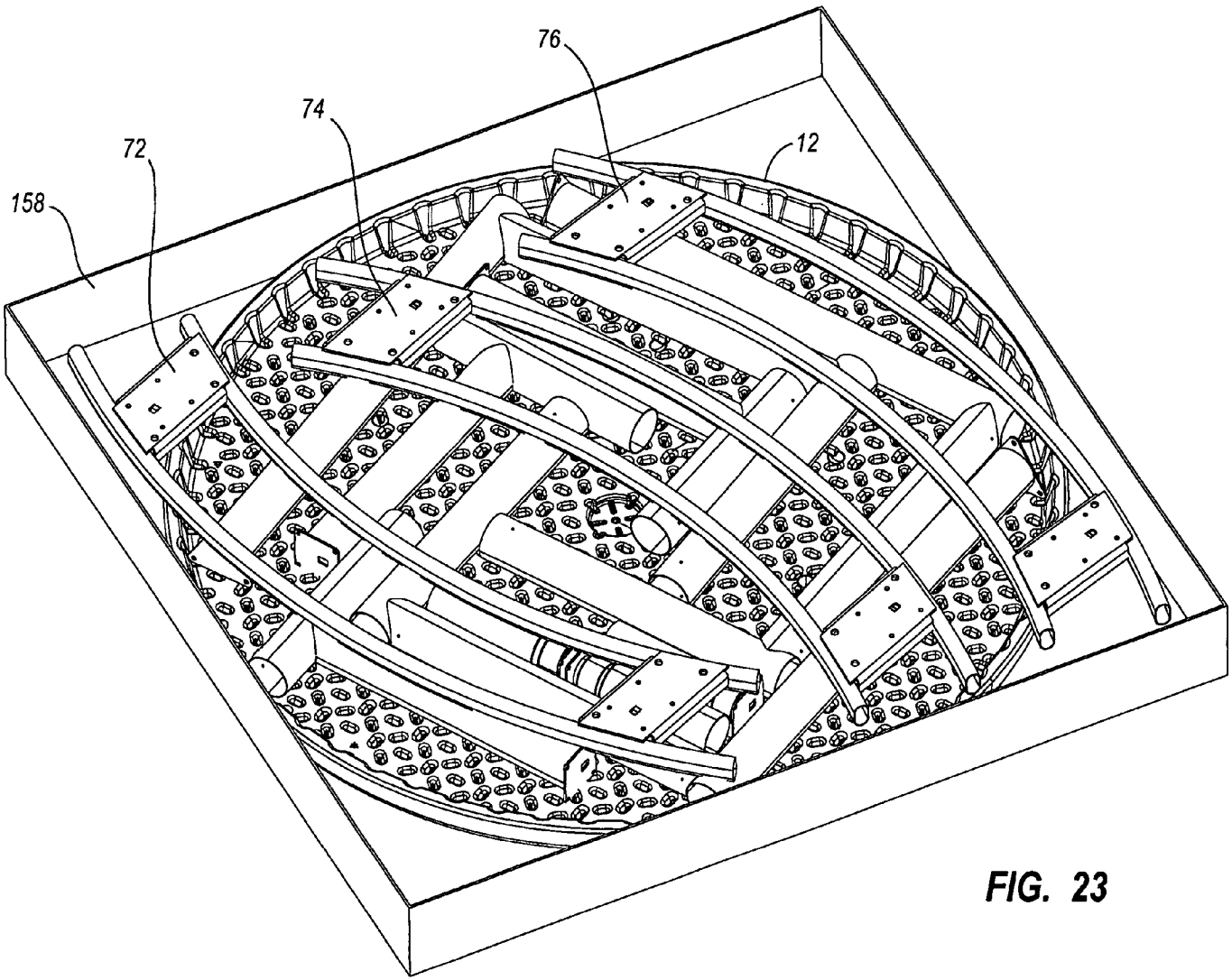
FIG. 23 is yet another perspective view of an exemplary arrangement for disposing various components of a picnic table within a container.
Figure 24:
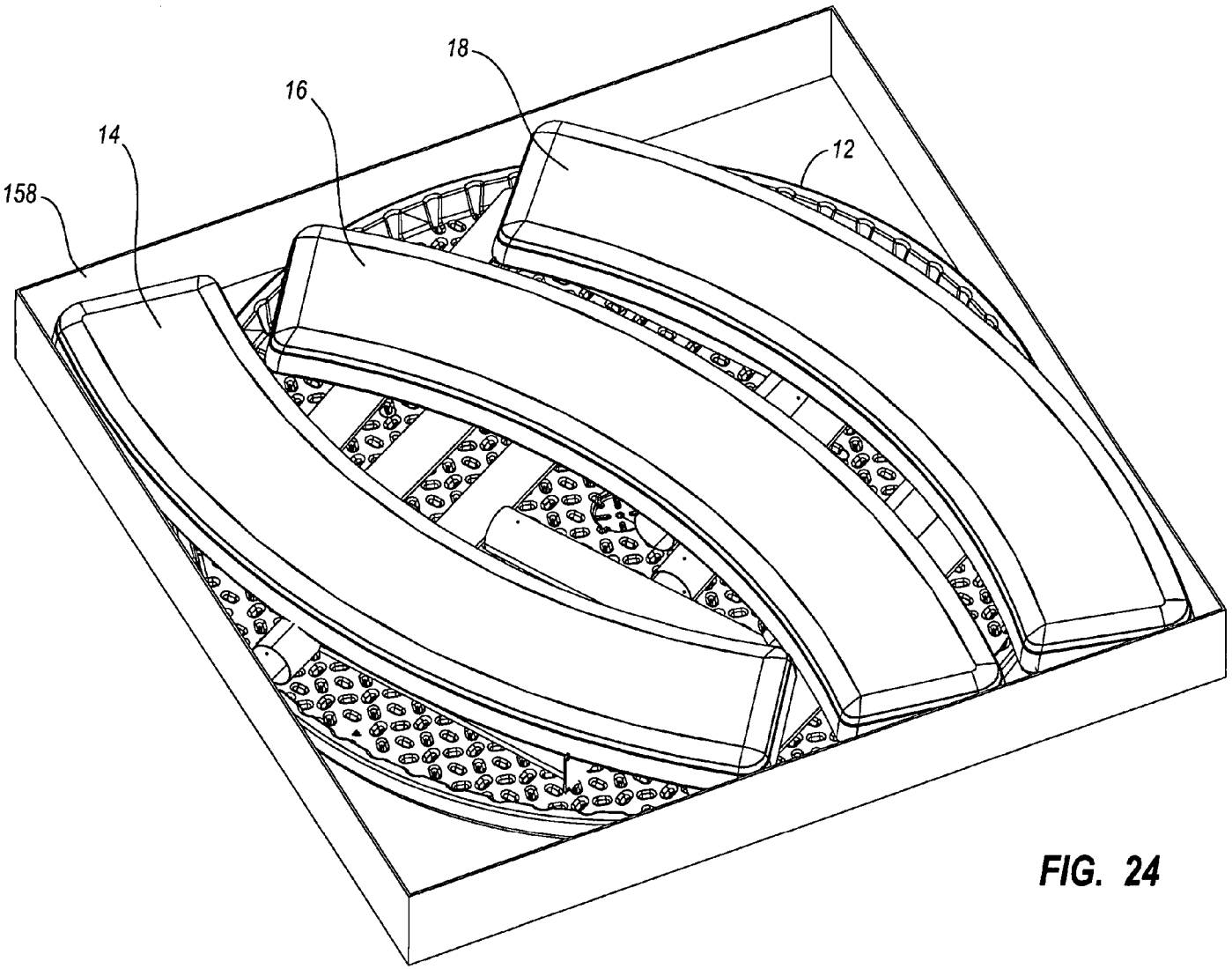
FIG. 24 is a further perspective view of an exemplary arrangement for disposing various components of a picnic table within a container.

As shown in FIGS. 20-24, the picnic table 10 may be efficiently packaged. In particular, the components of the picnic table 10 may be positioned in various suitable arrangements to minimize the size of the packaging, which may help reduce shipping and storage costs. For example, the table top 12 may include a recessed portion in which at least a portion one or more components of the picnic table 10 may be disposed for shipping or storage. In greater detail, the support structures 42, 44, 46, the support structures 54, 56, 58, and/or the supports 102 may be at least partially disposed within the recessed portion of the table top 12, as shown in FIGS. 20-22. In addition, the seat members 14, 16, 18 may include a recessed portion in which at least a portion one or more components of the picnic table 10 may be disposed for shipping or storage. For example, the bench frames 72, 74, 76 may be at least partially disposed with the recessed portions of the seat members 14, 16, 18, as shown in FIGS. 23-24.

In greater detail, an exemplary packaging arrangement may include the table top 12; at least one of the support structures 42, 44, 46, 54, 56, 58 positioned against or proximate the table top; and one or more of the seat members 14, 16, 18 positioned against or proximate the support structure. This exemplary packaging arrangement is preferably relatively compact. For example, the thickness of this arrangement may be generally equal to or less than twice the thickness of one of the support structures 42, 44, 46, 54, 56, 58. The thickness of this arrangement may be less than 75% of the sum of the individual thicknesses of the table top, the support structure and the seat member. It will be appreciated, however, that various components of the picnic table 10, including the table top 12, the support structures 42, 44, 46, 54, 56, 58, and the seat members 14, 16, 18 may have other suitable arrangements, thicknesses and the like.

The table top 12 and the seats 20 are preferably constructed from a lightweight material such as plastic. In particular, these and other components may be constructed from high density polyethylene and these components are desirably formed by a blow-molding process. The blow-molding process may allow strong, lightweight, rigid and sturdy components-to be quickly and easily manufactured. In particular, the blow-molded components may include a hollow interior portion that is formed during the blow-molding process, which may allow a lightweight component to be manufactured. Advantageously, this may allow the picnic table 10 to have significantly lighter weight than conventional furniture constructed from wood or metal. In addition, constructing the table top 12 and the seats 20 from blow-molded plastic may allow the table top and the seats to be constructed from less plastic, which may save manufacturing costs and reduce consumer costs. The blow-molded plastic may also include ultraviolet (UV) inhibitors that help prevent the plastic from deteriorating when exposed to sunlight. It will be appreciated that other suitable plastic, materials and/or processes may also be used to construct these and other components depending, for example, upon the particular design and use of the table top 12 and the seats 20.

The table top 12 and the seats 20 may also be constructed from blow-molded plastic because this may allow the table top and seats to be economically manufactured. In addition, the blow-molded plastic may allow the table top 12 and the seats 20 to be readily produced because, among other reasons, their components may be quickly manufactured and the blow-molded plastic components may be created with a variety of suitable shapes, sizes, designs and/or colors depending, for example, upon the intended use of the table and the seat members. Also, the blow-molded process may allow the some or all of the components of the table top 12 and the seats 20 to be integrally formed as part of a unitary, one-piece structure, which may advantageously reduce manufacturing time and costs. Further, the blow-molded plastic components may be durable, weather resistant, generally temperature insensitive, corrosion resistant, rust resistant and generally do not deteriorate over time. Thus, the blow-molded plastic may allow long-lasting and durable table tops and seats to be constructed.

The blow-molded plastic table top 12 and the seats 20 may also include one or more depressions, indentations or the like, and these depressions may be sized and configured to increase the strength and/or rigidity of the component. These depressions, which may also be known as "tack-offs," preferably cover at least a substantial portion of the components and the depressions may be arranged into a predetermined pattern. The depressions, for example, may be formed in one surface and extend towards an opposing surface. The ends of the depressions may contact or engage the opposing surface and/or the ends of the depressions may be spaced apart from the opposing surface. Advantageously, the depressions may help support the opposing surface and/or increase the structural integrity of the component. In addition, the depressions may be closely spaced in order to increase the strength and/or structural integrity of the component. Further, the depressions may be spaced or positioned into a generally regular or constant pattern so that the component has generally consistent properties. It will be appreciated that the depressions may have a variety of suitable configurations and arrangements. For instance, additional information regarding suitable configurations and arrangements of the depressions is disclosed in Assignee's co-pending U.S. patent application Ser. No. 10/490,000, entitled HIGH STRENGTH, LIGHT WEIGHT BLOW-MOLDED PLASTIC STRUCTURES, which was filed on Apr. 8, 2003; and U.S. Provisional Patent Application Ser. No. 60/659,982, entitled HIGH-STRENGTH, LIGHT-WEIGHT BLOW-MOLDED PLASTIC STRUCTURES, which was filed on Mar. 9, 2005. These applications are incorporated by reference in their entireties.

The depressions may also be positioned on opposing surfaces of the table top 12 and the seats 20, if desired. For example, one or more depressions may be formed on a first surface and these depressions may extend towards and/or contact the second, opposing surface. In addition, one or more depressions may be formed on the second surface and these depressions may extend towards and/or contact the first surface. These depressions on the first and second surfaces may be generally aligned and the ends of the opposing depressions may touch or engage. Significantly, this may create depressions that may contact and support the opposing surface, but the depressions have a smaller size and/or height than conventional depressions because the depressions do not span the entire distance between the opposing surfaces. In contrast, the depressions on the opposing surfaces only span a portion of the distance separating the opposing surfaces.

One skilled in the art, however, will appreciate that the table top 12 and the seats 20 do not have to be constructed from blow-molded plastic and other suitable materials and/or processes can be used to construct these and other various components of the picnic table depending, for example, upon the intended use of the picnic table. Thus, some or all of the components could also be constructed from other materials with suitable characteristics, such as wood, metal and other types of plastic. Additionally, all the components do not have to be constructed from blow-molded plastic and some or all of the components could be constructed from injection molded plastic, extrusion molded plastic, and the like.

Various portions of the picnic table 10, such as the frame 22; the support structures 42, 44, 46, 54, 56, 58; the supports 24, 26, 28, 30, 32, 34, 36, 38, 40, 48, 50, 52, 60, 62, 64, 102, 132; the bench frames 72, 74, 76; the rails 78, 80, 82, 84, 86, 88; the brackets 90, 92, 94, 96, 98, 100; the plates 110, 114;

and the reinforcement assembly 130; are preferably constructed from a strong and high-strength material such as metal and, in particular, steel. Advantageously, these metal components of the picnic table may be relatively durable and strong. Desirably, these metal components are constructed from thin-walled metal tubing, which may allow a strong and lightweight picnic table 10 to be constructed. The thin-walled metal tubing may have a small diameter and the tubing may be sized and configured to maximize the legroom for a user. It will be appreciated that the metal tubing may have a generally circular, oval, square, rectangular or other suitable shape, and these and other components may be constructed from other materials with suitable characteristics.

Other portions of the picnic table 10, such as the feet 140, 142, may be constructed from injection molded plastic. This may allow strong and resilient feet 140, to be constructed. It will be appreciated, however, that the feet 140, 142 and other portions of the picnic table 10 may be constructed using other materials and/or processes. Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. An apparatus comprising:

a table top including an outer perimeter;

a first elongated bench including a first end, a second end, an inner portion and an outer portion, the first bench being movable between a first position and a second position relative to the table top, the first position including the first end, the inner portion and the second end of the bench being disposed proximate the outer perimeter of the table top so that a person can use the bench, the second position including at least a portion of the inner portion and the second end of the bench being disposed away from the outer perimeter of the table top;

a first generally U-shaped support structure connecting the table top and the first elongated bench, the first generally U-shaped support structure being sized and configured to support at least a portion of the table top and at least a portion of the first bench, the first generally U-shaped support structure being sized and configured to allow the first bench to pivot between the first position and the second position relative to the table top, the first generally U-shaped support structure comprising:

a first table support leg connected to the table top;

a first bench support leg connected to the first end of the first bench; and a connecting member connecting the first table support leg and the first bench support leg, the connecting member having a constant length that spaces the first table support leg and the first bench support leg apart by a constant distance;

a second bench support leg connected to the second end of the first bench, the second bench support leg being spaced apart from the first bench support leg by a distance, the first bench support leg and the second bench support leg being sized and configured to support the first bench above a surface, the second end of the first bench being freely movable relative to the table top; and a frame connected to the table top, the frame including a plurality of elongated supports with generally the same shape and configuration, each of the elongated supports including a first end, a second end and a connecting point disposed at least proximate a midpoint between the first end and the second end, a first end of each of the elongated supports connected to the connecting point of an adjacent elongated support to interconnect the plurality of elongated supports and form a generally polygon-shaped structure, the second end of each of the elongated supports extending beyond the perimeter of the generally polygon-shaped structure and being disposed towards an outer periphery of the table top.

2. The apparatus as in claim 1, wherein the first bench is pivotally connected to the first support structure proximate the first end of the bench.

3. The apparatus as in claim 1, further comprising a foot connected to the first support structure, the foot including a receiving portion that is sized and configured to receive a portion of the table support and a cradle that is sized and configured to abut a portion of the connecting member.

4. The apparatus as in claim 1, further comprising a foot connected to the first support structure, the foot including a receiving portion that is sized and configured to receive a portion of the table support and a drain that is sized and configured to allow liquid to exit the foot.

5. The apparatus as in claim 1, wherein the second bench support leg includes a lower portion that is connected to a lower end of the second bench support leg, the lower end of the second bench support leg being connected closer to a first end of the lower portion than a second end of the lower portion so that the connection of the second bench support leg to the lower portion is offset towards the first end of the lower portion.

6. The apparatus as in claim 1, wherein the second bench support leg includes a lower portion that is connected to a lower end of the second bench support leg, the lower portion including a first end that is disposed towards the table top and a second end that is disposed away from the table top, the second end extending beyond the outer portion of the first bench in a direction generally away from the table top when the first bench is in the first position.

7. The apparatus as in claim 1, further comprising:

a second elongated bench including a first end, a second end, an inner portion and an outer portion, the second bench being movable between a first position and a second position relative to the table top, the first position including the first end, the inner portion and the second end of the bench being disposed proximate the outer perimeter of the table top so that a person can use the bench, the second position including at least a portion of the inner portion and the second end of the bench being disposed away from the outer perimeter of the table top;

a second support structure connecting the table top and the second elongated bench, the second support structure being sized and configured to support at least a portion of the table top and at least a portion of the second bench, the second support structure being sized and configured to allow the second bench to pivot between the first position and the second position relative to the table top, the second support structure comprising:

a second table support leg connected to the table top;

a first bench support leg connected to the first end of the second bench; and a connecting member connecting the second table support leg and the first bench support leg; and a second bench support leg connected to the second end of the second bench, the second bench support leg being spaced apart from the first bench support leg by a distance;

wherein the first bench support leg and the second bench support leg are sized and configured to support the second bench above a support surface; and wherein the second end of the second bench is freely movable relative to the table top.

8. The apparatus as in claim 1, further comprising a table frame that is connected to the first support structure and is sized and configured to support at least a portion of the table top, the table frame including a plurality of supports that are interconnected to form a generally polygon-shaped structure, at least a portion of each of the plurality of supports extending beyond the generally polygon-shaped structure.

9. The table as in claim 1, wherein the first end of each of the elongated supports forms a portion of the perimeter of the generally polygon-shaped structure of the frame; and wherein the first end of each of the elongated supports is disposed towards a center portion of the table top and away from the outer periphery of the table top.

10. The table as in claim 1, wherein the generally polygon-shaped structure of the frame has at least five sides and each of the elongated supports has approximately the same length.

11. The table as in claim 1, further comprising:

a second support structure connected to the table frame, the second support structure being sized and configured to support the table top above the surface;

a third support structure connected to the table frame, the third support structure being sized and configured to support the table top above the surface; and a reinforcement assembly connected to the first support structure, the second support structure and the third support structure.

12. The table as in claim 1, further comprising a foot connected to the first support structure, the foot including a receiving portion and at least one drain, the receiving portion being sized and configured to receive a portion of the first support structure, the at least one drain being sized and configured to allow liquid to exit the receiving portion of the foot.

13. A table and bench system comprising:

a table top;

a first elongated bench including a first end, a second end and a length that is sufficient to allow at least two persons to sit on the first bench, the first bench being movable relative to the table top;

a first connection assembly connecting the first end of the first bench and the table top, the first connection assembly comprising:

a first portion forming at least a portion of a first table support leg;

a second portion forming at least a portion of a first support leg for the first bench; and a connecting member connecting the first portion and the second portion of the connection assembly, the connecting member having a constant length that spaces the first portion and the second portion of the connection assembly apart by a constant distance;

a second support leg connected to the second end of the first bench, the second support leg for the first bench being separate from and spaced apart by a distance from the first support leg of the first bench, the first bench support leg and the second bench support leg being sized and configured to support the first bench above a surface, the second end of the first bench being freely movable relative to the table top;

a second elongated bench including a first end, a second end and a length that is sufficient to allow at least two persons to sit on the second bench, the second bench being movable relative to the table top;

a second connection assembly connecting the first end of the second bench and the table top, the second connection assembly comprising:

a first portion forming at least a portion of a second table support leg;

a second portion forming at least a portion of a first support leg for the second bench; and a connecting member connecting the first portion and the second portion of the connection assembly, the connecting member having a constant length that spaces the first portion and the second portion of the connection assembly apart by a constant distance;

a second support leg connected to the second end of the second bench, the second support leg for the second bench being separate from and spaced apart by a distance from the first support leg of the second bench, the first bench support leg and the second bench support leg being sized and configured to support the second bench above a surface, the second end of the second bench being freely movable relative to the table top; and a frame connected to the table top, the frame including a plurality of elongated supports with generally the same shape and configuration, each of the elongated supports including a first end, a second end and a connecting point disposed at least proximate a midpoint between the first end and the second end, a first end of each of the elongated supports connected to the connecting point of an adjacent elongated support to interconnect the plurality of elongated supports and form a generally polygon-shaped structure, the second end of each of the elongated supports extending beyond the perimeter of the generally polygon-shaped structure and being disposed towards an outer periphery of the table top.

14. The table and bench system as in claim 13, wherein the table top includes a curved outer surface with a radius of curvature;

wherein the inner surface of the first bench includes a curved inner surface with a radius of curvature; and wherein the radius of curvature of the outer surface of the table top is generally equal to the radius of curvature of the inner surface of the first bench.

15. The table and bench system as in claim 13, wherein the first bench is movable between a use position in which the first end and the second end of the first bench are disposed outside an outer perimeter of the table top, and a storage position in which the second end of the first bench is disposed inside the outer perimeter of the table top.

16. The table and bench system as in claim 13, wherein the first portion of the first connection assembly is pivotally connected to the table top and the second portion of the first connection assembly is pivotally connected to the first end of the first bench.

17. The table and bench system as in claim 13, wherein the first end of each of the elongated supports forms a portion of the perimeter of the generally polygon-shaped structure of the frame; and wherein the first end of each of the elongated supports is disposed towards a center portion of the table top and away from the outer periphery of the table top.

18. The table and bench system as in claim 13, wherein each of the elongated supports of the frame has approximately the same length.

* * * * *

UNITED STATES PATENT AND TRADEMARK OFFICE

CERTIFICATE OF CORRECTION

PATENT NO. : 7,971,930 B2
APPLICATION NO. : 11/409301
DATED : July 5, 2011
INVENTOR(S) : Larsen et al.

It is certified that error appears in the above-identified patent and that said Letters Patent is hereby corrected as shown below:

In the Specifications:

In Column 4, Line 34, delete “a” and insert -- an --, therefor.

In Column 4, Line 65, delete “support” and insert -- supports --, therefor.

In Column 5, Line 12, after “34.” insert -- As shown in FIGS. 1-3, the intermediate supports 48, 50, 52 may have a length generally equal to or greater than a length of the seat legs or supports 30, 32, 34, 36, 38, 40 that support the seat members 14, 16, 18, respectively. --.

Figure 5:
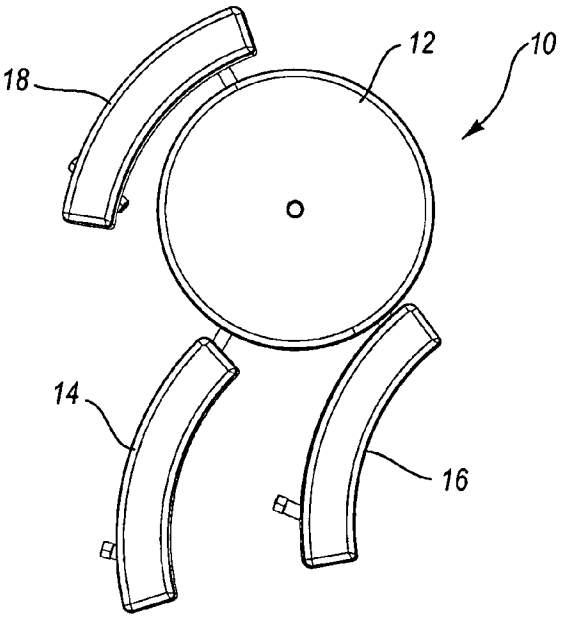
FIG. 5 is a top view of the picnic table shown in FIG. 1, illustrating another exemplary position of the seat members.

In Column 5, Lines 26-35, delete “In greater detail, .....respectively.” and insert -- Because the seat members 14, 16, 18 may pivot, rotate or otherwise move between a variety of positions, persons may more comfortably and conveniently access and exit the seat member regardless of age, size, or physical dexterity. Additionally, the seat members 14, 16, 18 may allow the users to face substantially the same direction, for example, as shown in Figure 5. Also, the seat members 14, 16, 18 may be sized and configured to move between an extended or use position (as shown, for example, in Figures 1, 2 and 4) and a retracted or storage position (as shown, for example, in Figures 6 and 7). Advantageously, this may allow the picnic table 12 to be stored and/or shipped in a more compact configuration. Desirably, all or at least a portion of the seat members 14, 16, 18 are positioned underneath the table top 12 in the retracted or storage position. In addition, one or more of the seat members 14, 16, 18 may be positioned generally underneath the table top in the storage position, while the other seat members may be positioned in the extended or use position. It will be appreciated that the seat members 14, 16, 18 may be positioned in a variety of suitable positions, whether in fixed or movable locations. --, therefor.

In Column 8, Line 13, delete “that is is” and insert -- that is --, therefor.

Signed and Sealed this
Twentieth Day of November, 2012

David J. Kappos

David J. Kappos
*Director of the United States Patent and Trademark Office*

In Column 9, Lines 35-36, delete “components-to be” and insert -- components to be --, therefor.

In Column 11, Line 16, delete “140,” and insert -- 140, 142 --, therefor.